United States Patent [19]

Peschel born Chaudron et al.

[11] 4,243,057

[45] Jan. 6, 1981

[54] PROCESS FOR SPREADING TOBACCO LEAVES

[75] Inventors: Huguette Peschel born Chaudron, Paris; Robert Caffoz, Checy, both of France

[73] Assignee: Service d'Exploitation Industrielle des Tabacs et des Allumettes, Paris, France

[21] Appl. No.: 828,992

[22] Filed: Aug. 30, 1977

[30] Foreign Application Priority Data

Sep. 1, 1976 [FR] France ..... 76 26326

[51] Int. Cl.[3] ..... A24B 3/18; A24B 3/00

[52] U.S. Cl. ..... 131/147 A

[58] Field of Search ..... 131/123, 140 R, 147 R, 131/147 A

[56] References Cited

U.S. PATENT DOCUMENTS

| | | | |
|---|---|---|---|
| 1,348,497 | 8/1920 | Kahn | 131/147 R |
| 2,229,546 | 10/1937 | Bogaty | 131/140 R |
| 3,515,149 | 6/1970 | Meyer | 131/125 |
| 3,699,977 | 10/1972 | Hollenton | 131/147 R |
| 3,759,269 | 9/1973 | Wallenborn | 131/147 R |
| 3,800,807 | 4/1974 | Hays et al. | 131/147 R |

*Primary Examiner*—V. Millin

*Attorney, Agent, or Firm*—Holman & Stern

[57] ABSTRACT

A process for spreading out tobacco leaves for use in particular as cigar wrappers, comprising the steps of putting the leaves in contact with a liquid, preferably water, and bringing about a relative movement of the leaves and the liquid in contact with said leaves, said movement affecting the spreading out of the leaf.

6 Claims, 8 Drawing Figures

PROCESS FOR SPREADING TOBACCO LEAVES

BRIEF SUMMARY OF THE INVENTION

The present invention relates to a process for spreading tobacco leaves for their use as cigar wrappers.

It is already known, in order to reach such a result, to centrifuge tobacco leaves grouped in "hands" generally, that is in bunches previously soaked in a water bath and dripped. The effect of the centrifugation is to display the leaf tissue while accelerating dripping.

It is also already known to spread tobacco leaves via diverging systems such as endless conveyor belts, the belts being generally aspirating, brushes or any element capable via mechanical means to act on the leaf tissue for displaying it.

It is also possible to use air jets which conveniently directed spread the leaf parenchyma, the result being more quickly reached and of better quality if the leaf has been previously wetted. However, in order to operate under the best conditions, one has to provide the air jets with a high pressure since the air expands very quickly in the atmosphere and the action of each air jet is limited to a point, line or area of impact of the air on the leaf which has a small surface (according to the shape of the jets). Moreover, such a treatment is rather brutal: the pressure force used for achieving a good spreading of the leaf carries the risk of increasing the leaf limb imperfections such as small holes, tears, etc. which were initially acceptable.

To obviate such disadvantages, the invention provides a process for spreading tobacco leaves, which is simple, not costly, quick to operate and more efficient as the leaves used have been previously wetted, for instance by passing through a wetting apparatus operating under vacuum and of known type.

According to the invention, the leaves are individually brought in contact with a liquid, preferably water, and there is induced a relative movement of the leaves and the water film which is in contact with the leaves, which movement always ends in the direction where the leaf spreads.

The preference for water is obvious, but the invention is not limited to such a liquid. It will be understood that spreading by means of a liquid medium provides, due to the density difference, the substantial advantage of an action which is more efficient than that obtained with a gazeous fluid which is very generally air.

Through the global contact of leaf and water, the resiliency of the leaf is very quickly restored and such a resiliency favours the relaxation of the parenchyma and its display. The relative movement of the leaf and water terminates the unfolding and causes the limb to spread out.

The result is very quickly achieved since there is a simultaneous combination of the wetting of leaves in order to restore some degree of flexibility and the movement which spreads them out. This offers a great advantage compared to the solution involving an additional handling and consisting in soaking the leaves first, then spreading them out with mechanical means or air jets presenting moreover, the former as well as the latter, the aforementioned disadvantages.

In order to obtain the relative movement of the leaves and water, two solutions are available:

A. The first consists in moving the water in relation to the leaf. For so doing, it is for instance possible to maintain the leaf by the rib and to direct on either side of the rib, on each side of the leaf, diverging water jets directed from the rib towards the outside of the leaf; preferably the jets cross-section will be fan-shaped in order to provide maximum dispersion of the liquid on the parenchyma and thereby form a moving water stream remaining in contact with the full surface of the limb, from the point of contact to the leaf edges. The limb therefore can progressively resume its resiliency while it unfolds along the direction of the water stream due to the uniform force exerted on all its surface. The restored flexibility of the parenchyma as well as the uniformity of the water action provide the possibility of preserving the leaf integrity and respecting the fragility of the limb without aggravating the imperfections which might be present.

An alternative to this solution consists in forming a water film on the surface of a support, placing the leaf contact with said film, and in orientating water jets so as to obtain the best conditions for a quick and complete display of the parenchyma; the water film forms a mobile bed on which glides the leaf which spreads under the action of the water jets.

A further possibility consists in directing a circular water jet, hollow and diverging (of the type of those obtained with garden watering jets when the obturation is nearly closed) on a leaf layed flat on a support, the water jet being centered on the rib. By gradually raising the jet, the water impact area on the leaf grows larger and moves away from the rib. Progressive spreading of the half-leaves is thereby obtained on either side of the rib, via concentric zones.

B. The second solution consists in moving the leaf relative to the water. For instance, the leaves are quickly moved in a water bath by handling them by the rib so as to maintain said rib in a position which is in all possible measure rectilinear.

By means of such a movement, the leaf limb relaxes correctly on either side of the rib, the forces generated by the friction of the water and the swirl causing the folds to unfold. Moreover, their action is enhanced by the osmose phenomenon which brings about an absorption of the water by the cells of the parenchyma which is recovering its flexibility while spreading out.

The movement of the leaves in the water may be performed along a rectilinear, a vertical or a horizontal path. A vertical movement may be generated by sinking quickly in the water the leaf previously seized in a limited area: the resistance to water offered by the limb which is starting to spread by absorbing water causes the leaf to spread out while the rib offers a different resistance. A horizontal movement may be obtained either by moving the leaf rapidly over a distance sufficient to open the leaf or by to-and-fro movements.

Since all the forces exerted on the leaf follow directions parallel with respect to each other, the leaves remain substantially plane and are easily spread out.

One may also move the leaves along a curvilinear path via partly immersed conveyor means. In such a case, the spreading out of the parenchyma is brought about by the combination of the tractions exerted on the leaf and the reaction of the water on the limb.

In order to reach the best possible result, one endeavours to impart a movement to the conveyor means such that the resultant of the various forces is exerted along the direction of the leaf secondary ribs. The spreading is then performed on either side of said ribs.

In the above description, the effects of the movement have been considered as such. It is now necessary to point out how the leaf can be maintained while it is being spread out.

One of the most efficient means is to maintain the rib rectilinear, thereby allowing the limb to completely move on either side of said fixed portion.

Another means consists in squeezing, for instance between two small rules, the edge of the leaf limb over a length which is sufficient not to damage it while it moves in the water.

A further modality according to the invention consists in putting each leaf in contact with water, allowing said leaf to freely get soaked, then to move it in the liquid medium on the surface of a support.

Such a procedure allows the leaf, when completely immersed, to resume its initial surface by relaxing, then to unfold and spread out due to the movement of the support surface in relation to the leaf which is free to spread out on said support. The preliminary spreading is useful as it will thereafter allow the spreading support which will quickly move the leaf in the water to act on all the surface of said leaf.

It is thereafter possible:

to impart to the support a movement such that it lays the leaf flat on the bottom, in order to provide the recovery of a number of leaves when the vessel has been emptied, or the bottom wall being constructed as a double wall which is periodically removed.

to use the support for extracting the leaf from the medium in which it is immersed, the vertical movement from bottom to top laying it flat on a face of the support. The latter is then removed from the water and the leaf recovered for further treatment. In such a case, the support may be finely grooved or perforated for facilitating the movements of the water between leaf and support.

BRIEF DESCRIPTION OF SEVERAL VIEWS OF THE DRAWING

The process according to the invention will now become more apparent from the following description of some non limitative embodiments thereof when taken in conjunction with the accompanying drawings wherein.

Figure 1:
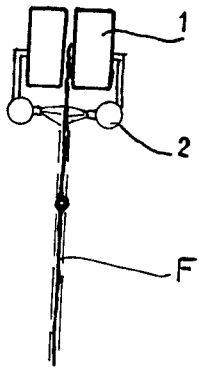
FIG. 1 shows an embodiment according to the first solution (A) wherein the leaf is maintained by its edge.

According to FIG. 1, the edge of the parenchyma of each leaf F is squeezed between two small rules 1 and water jets are projected on either side of the leaf via nozzles 2. The water film which is forming below the impact area of the jets on the leaf drips downwards and relaxes the leaf limb. When need be, one may turn the leaf over and perform the same treatment, the jets being projected on the half-leaf which was previously situated below.

Figure 2A:
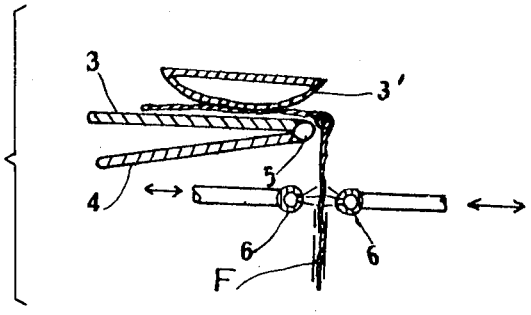
FIG. 2 shows also an embodiment according to the first solution, wherein each half-leaf is alternately maintained.
Figure 2B:
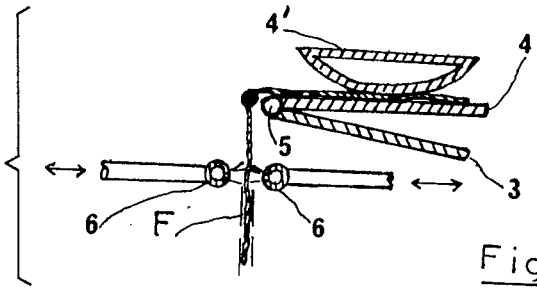
Figure 2C:
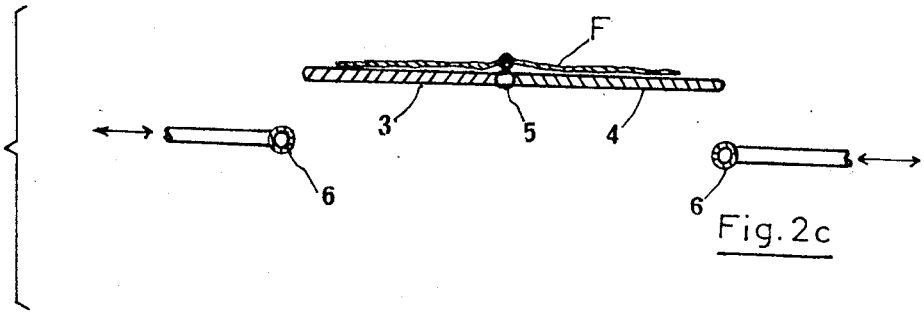

According to FIG. 2, leaf F is placed at a right angle: the horizontal half-leaf laying on a support and the other half-leaf remaining free. The support has two shutters 3 and 4 articulated at 5. Water jets originating from the spraying installation 6 come and smooth the vertical half-leaf. Pads 3' and 4' placed respectively above shutters 3 and 4 are mounted for being applied on the half-leaf laying on the shutter and maintain it against the sliding force due to the action of the water jets on the other half-leaf. Shutters 3 and 4 are then rotated through 180° about 5 after the spraying installations 6 have been retracted. The spread out half-leaf is then applied on shutter 4 while the half-leaf which was layed on 3 is freed and subjected to the jets after the spraying installations have resumed their position. Shutter 3 then moves back for taking the new spread out half-leaf. A well spread out leaf is thereby obtained on the two shutters 3 and 4 which are then laying flat.

Figure 3:
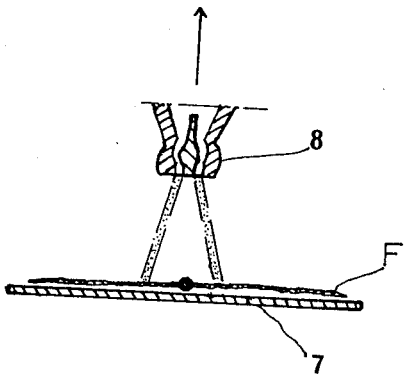
FIG. 3 illustrates a further embodiment of the first solution (concentric water jets)

According to the modality of FIG. 3, the leaf is placed horizontally on a support 7. A jet 8 situated perpendicularly to the rib and of the garden watering jet type projects a hollow and conical water jet. Said jet is vertically raised for projecting a circular jet with a diameter growing as the distance from the leaf surface increases. The spreading is thereby provided in concentric areas from the rib towards the outside of the leaf.

Figure 4:
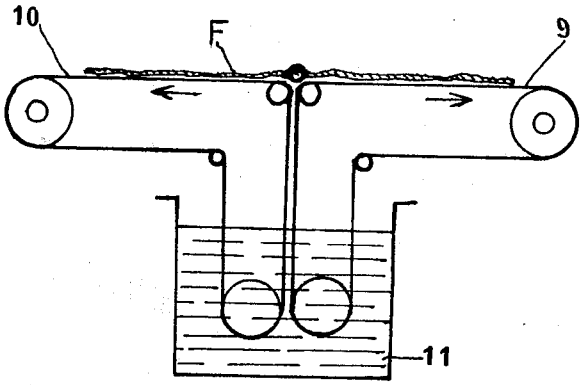
FIG. 4 shows a further alternative of this type of solution.

According to the modality of FIG. 4, leaf F is placed on the surface of two endless conveyor belts 9 and 10, the horizontal strands of which move in opposite directions. Part of said conveyor means is shaped so as to pass through a water bath 11. A water film forms on the conveyor belt and provides a bed for the leaf. The movement of each of the conveyor spreads each half-leaf in the direction of its movement. The humidity provided by the passage through the water bath facilitates the spreading of the parenchyma.

Figure 5:
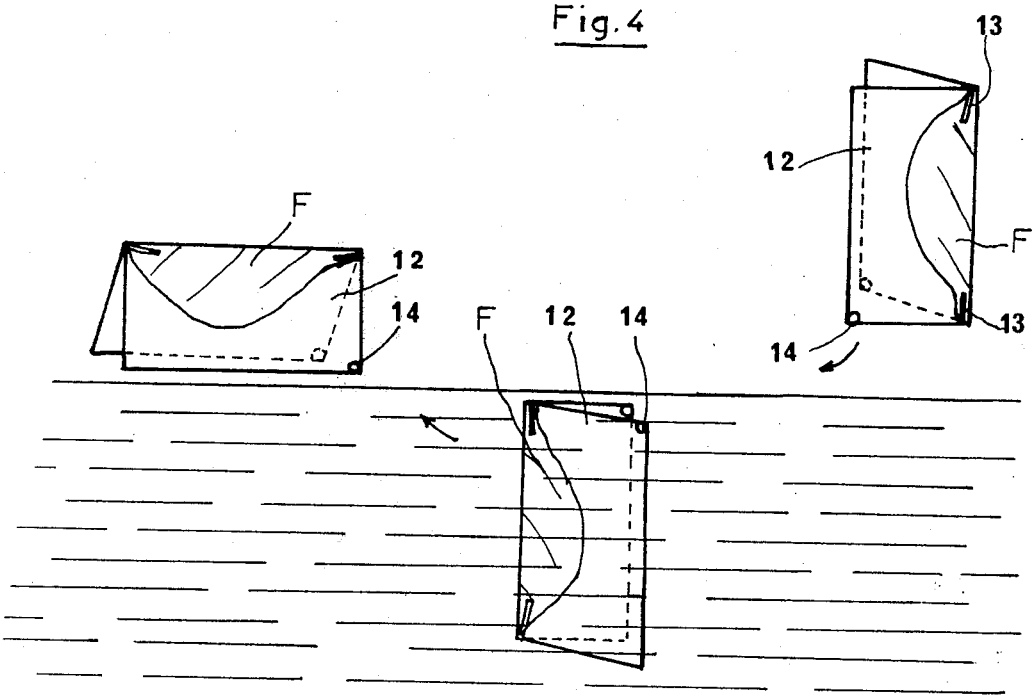
FIG. 5 shows an application of the second solution (B).

According to FIG. 5, leaf F is placed astride on a support 12 having the shape of a dihedron. The rib lays on the edge of the dihedron and is maintained thereon by clamps 13. This support may rotate about an axis 14 and this axis moves for example on a chain along a determined path in a water bath. When the support emerges from the water, the half-leaves are perfectly spread out on either side of the rib.

What we claim is:

1. A method of spreading out a tobacco leaf comprising bringing a liquid into contact with the leaf while creating relative movement between the leaf and the liquid in a direction which effects spreading of the leaf.

2. The method of claim 1 comprising supporting the leaf on a surface, propagating a diverging hollow conical liquid jet constituting said liquid, directing said jet onto said leaf with the central axis of the jet substantially perpendicular to said surface and intersecting the rib of the leaf, and moving the point of propagation of the jet along said axis to vary the impact area of the jet on the leaf.

3. The method of claim 1 including supporting the leaf such that at least one half of the leaf is disposed in a substantially vertical plane with the leaf rib disposed substantially horizontally and directing liquid jet means constituting said liquid onto the opposite surfaces of said half of the leaf.

4. The method of claim 3 wherein the leaf is suspended from an edge thereof.

5. The method of claim 3 wherein the other half of the leaf is supported on a substantially horizontal surface.

6. The method of claim 1 comprising supporting opposed halves of the leaf on a pair of endless surfaces with the rib of the leaf disposed substantially between said surfaces, said surfaces lying in planes which intersect each other, and driving each surface in a direction from the rib towards the periphery of the leaf and through a liquid to provide liquid on each of said surfaces.

* * * * *